United States Patent [19]

Cate

[11] 4,330,030

[45] May 18, 1982

[54] HEAT EXCHANGER ISOLATION MOUNTING ARRANGEMENT

[75] Inventor: Robert R. Cate, Dubuque, Iowa

[73] Assignee: Deere & Company, Moline, Ill.

[21] Appl. No.: 141,880

[22] Filed: Apr. 21, 1980

[51] Int. Cl.[3] ..... F28F 9/00

[52] U.S. Cl. ..... 165/67; 165/149; 165/150; 165/172

[58] Field of Search ..... 165/149, 150, 172, 67, 165/69

[56] References Cited

U.S. PATENT DOCUMENTS

| | | | |
|---|---|---|---|
| 2,828,095 | 3/1958 | Beck et al. | 248/9 |
| 2,998,639 | 9/1961 | Forst et al. | 165/150 |
| 3,042,380 | 7/1962 | Karmazin | 165/149 |
| 3,121,467 | 2/1964 | Bryant | 165/67 |
| 3,275,072 | 9/1966 | Suchomel | 165/134 |
| 3,318,409 | 5/1967 | Kiehnle | 165/67 |
| 3,391,732 | 7/1968 | Murray | 165/76 |
| 3,929,201 | 12/1975 | Hoffman | 165/67 |

FOREIGN PATENT DOCUMENTS

| | | | |
|---|---|---|---|
| 411363 | 6/1910 | France | 165/67 |
| 547545 | 12/1922 | France | 165/67 |
| 177388 | 12/1961 | Sweden | 165/172 |

*Primary Examiner*—Sheldon J. Richter

[57] ABSTRACT

A serpentine tube heat exchanger is mounted to support racks utilizing a plurality of isolation rings composed of elastomeric material. To secure the serpentine tube to the support rack, a plurality of isolating support rings are co-linearly aligned such that the looped portion of a serpentine tube can be positioned thereon. A bolt is then passed through the support rack and isolating rings; thereafter, a mating nut is attached. Each isolation ring is generally cylindrical in shape having a collar at one end. Each ring has a hole therethrough having a metal cylindrical ring bonded to the surface of the hole.

3 Claims, 3 Drawing Figures

FIG. 1
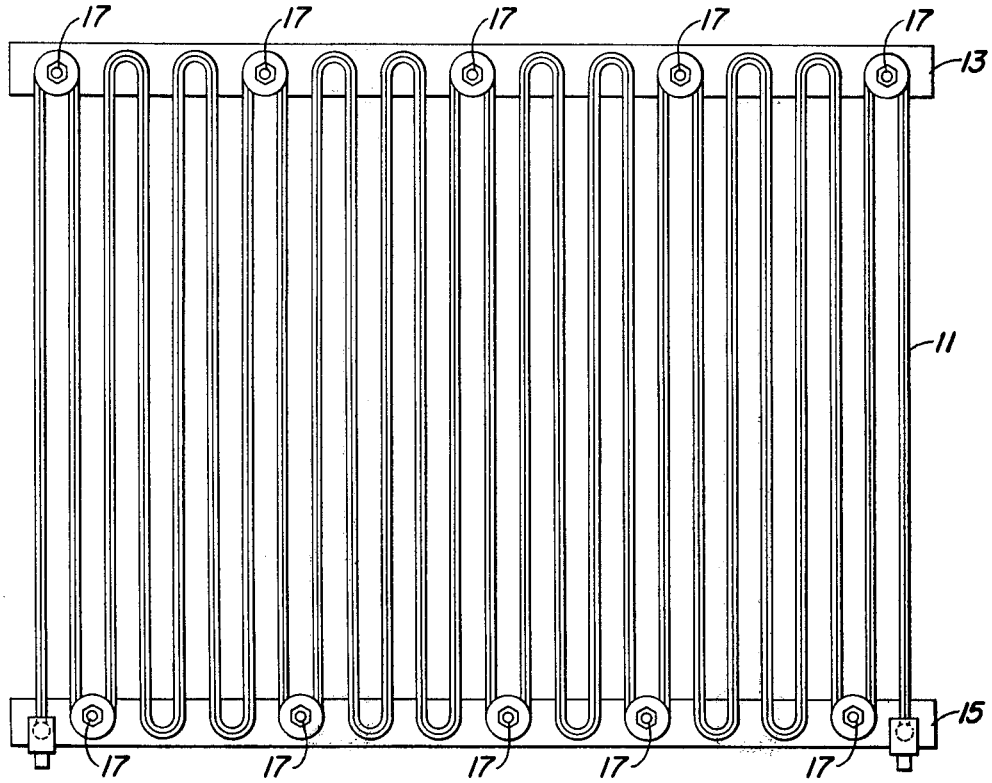
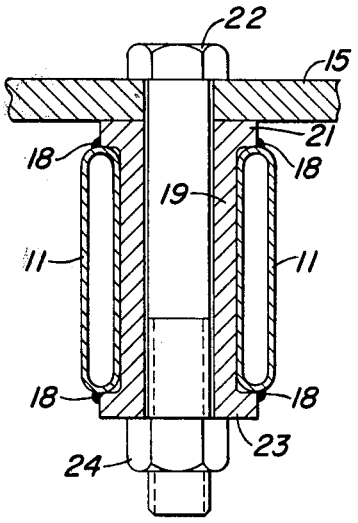
FIG. 2
(prior art)
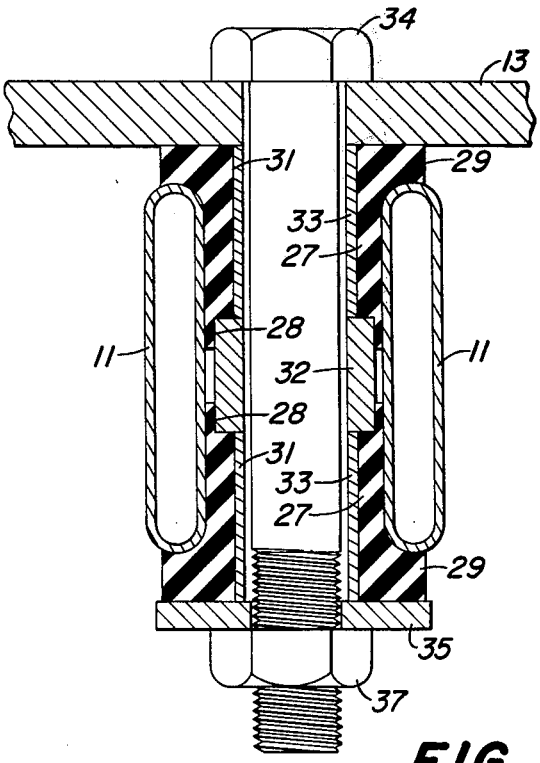
FIG. 3

HEAT EXCHANGER ISOLATION MOUNTING ARRANGEMENT

BACKGROUND OF THE INVENTION

This invention relates to heat exchangers and more particularly to isolation mounting arrangements of serpentine tube heat exchangers.

Vehicles commonly use serpentine tube heat exchangers as heat coils, condenser coils, and oil coolers. A serpentine tube heat exchanger is conventionally secured to a support rack. One means of supporting the serpentine tube heat exchanger to the support rack is to use a flat washer, cap screw and nut to clamp the tube loops to the support rack. Because the tube material, generally aluminum, is not sufficient to withstand high cap screw torque, the screw works loose under vibration causing fretting and eventual failure of the tube. Another method of securing the serpentine tube to a support rack is to place a spool between the loops of the tube and weld the spool in the flange area to the tubes. However, many times this weld is not sufficient to withstand vibration, causing the tube to break loose from the spool. Thus, the spool is free to fret causing failure of the tube. In cases where the weld is sufficient to maintain the bond, apparently the heat required to form the weld causes the tube to become brittle and vibration causes the tube to crack.

The present invention provides a means for mounting a serpentine tube heat exchanger to a support rack which does not degrade the heat exchanger material and minimizes the effect of vibration.

SUMMARY OF THE INVENTION

A serpentine tube type heat exchanger is mounted to support racks by placing an elongated elastomer support ring into each side of the looped portion of the serpentine tube separated by a metallic spacer ring. The elastomer support ring has a hole extending longitudinally therethrough having a bonded metal surface. Each support ring also has a collar region formed at one end. A cap screw is passed through the support rack and the support rings, such that the serpentine tube is secured between the collars of the rings. A washer is placed around the cap screw beyond the support ring collar and a mating nut is secured to the bolt to allow the collars of the opposing support rings hold the serpentine tube therebetween.

It is the objective of the present invention to present an effective vibration isolation mounting arrangement for a serpentine tube type heat exchanger.

BRIEF DESCRIPTION OF THE DRAWINGS

FIG. 1 is an elevational view of a serpentine tube type heat exchanger mounted to support racks.

FIG. 2 presents a prior art mounting arrangement for a serpentine tube type heat exchanger.

FIG. 3 shows a sectional view of the mounting arrangement in accordance with the present invention.

DETAILED DESCRIPTION OF THE PREFERRED EMBODIMENT

Referring to FIG. 1, a serpentine tube type heat exchanger 11 is mounted to an upper support rack 13 and a lower support rack 15 at mounting stations 17.

Referring to FIG. 2, a prior art mounting arrangement utilized at location 17 on racks 13 and 15 is shown. The prior art mounting arrangement consists of taking a metallic support ring 19 and placing it to extend lengthwise in a looped portion of the serpentine tube 11 at 17. The support ring 19 has collars 21 and 23 which contact with the ends of the serpentine tube 11 in the looped area. A heat weld is placed at 18 to secure the serpentine tank tube to the collars 21 and 23 of the support ring 19. A cap screw 22 is then passed through the support rack, for example, rack 15, and support ring 19. Thereafter, a mating nut 24 is secured to the cap screw. It is observed that should the weld fail due to vibration, fretting can occur causing the serpentine tube to fail. It is further observed that if the weld is formed by using excessive heat, the serpentine tube material is degraded to the extent that vibration can cause the tube to crack.

Referring to FIG. 3, a serpentine tube heat exchanger 11 having a preformed looped portion is mounted to support racks 13 and 15 at locations 17 using a plurality of isolation support rings 27 at each location 17. Each isolation support ring 27 is composed of an elastomer material having a generally cylindrical shape and a collar 29. A hole 31 is placed in the support ring 27. A metallic cylindrical ring 33 is bonded to the surface of hole 31.

To mount the serpentine tube 11, two support rings 27 separated by metal spacer ring 32 are co-linearly aligned. Each support ring 27 can include a recess 28 to receive a portion of spacer 32. A looped portion of tube 11 is then placed around the support rings 27 and spacer ring 32 such that the collar portion 29 of each support ring 27 abuts the side or ends of the serpentine tube 11. A cap screw 34 is then passed through support rack 13 or 15 at 17, the support rings 27 and ring 32. A washer 35 is then placed over the stem of cap screw 34 followed by a mating nut 37 secured to the cap screw 34. It is observed that this arrangement allows the elastomer substance to absorb vibrations without placing undue stress on serpentine tube 11 and looped area. The compressive loads created by tightening nut 37 allows the collars 29 to securely maintain the looped portion of tube 11 therebetween. The alignment of the bonded metal 33 and spacer ring 32 will guard against over tightening of nut 37. The radius of the spacer ring 32 can be slightly larger than the recess 23 such that tightening of nut 37 causes the spacer ring 32 to bulge the recess 28 against the interior surface of the looped portion of the tube 11 to provide additional vibration protection.

I claim:

1. In combination with the serpentine tube heat exchanger, a mounting arrangement comprising:

a. a support means for securing said serpentine tube heat exchanger thereto;

b. a plurality of support rings comprised of elastomer material having a hole therethrough and a collar formed at one end, said support rings having a generally cylindrical configuration.

c. a metallic ring bonded to the internal face of said hole of each of said support rings;

d. a spacer ring comprised of a metallic material;

e. clamping means for maintaining co-linear alignment between two of said support rings separated by said spacer ring, such that said collars of said support ring have therebetween the looped portion of said serpentine tube, said clamping means to maintain a compressive loading between said spacers and serpentine tube against said support means.

2. A mounting arrangement as claimed in claim 1, wherein said support rings further comprise a recess at one end opposite to said collar, sized to partially receive said spacer ring.

3. A mounting arrangement as claimed in claim 1, wherein said support rings further comprise a generally cylindrical shaped recess at one end opposite to said collar, said recess to have a depth sufficient to particularly receive said spacer ring and a radius less than said spacer ring such that insertion of said spacer ring into said recess causes said recess to bulge to contact the interior surface of said looped portion of said serpentine tube.

* * * * *